US006210156B1

(12) United States Patent
Horvath, Jr.

(10) Patent No.: US 6,210,156 B1
(45) Date of Patent: Apr. 3, 2001

(54) HEAT TREATMENT MATERIAL HANDLING UNIT

(75) Inventor: Joseph Paul Horvath, Jr., Speedway, IN (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/360,985

(22) Filed: Jul. 26, 1999

(51) Int. Cl.[7] ..... F27D 3/04

(52) U.S. Cl. ..... 432/125; 432/121; 432/126; 432/143; 414/152; 414/172; 414/796.8

(58) Field of Search ..... 432/142, 124, 432/143, 139, 98, 99, 121, 125, 126; 227/102, 107; 414/152, 153, 172, 210, 214, 222.1, 796.8

(56) References Cited

U.S. PATENT DOCUMENTS 3,790,336 * 2/1974 Brede, III et al. ..... 432/125
3,982,888 * 9/1976 Moussou et al. ..... 432/124
4,664,359 * 5/1987 Hertwich ..... 432/142

* cited by examiner

*Primary Examiner*—Gregory Wilson
(74) *Attorney, Agent, or Firm*—George A. Grove

(57) ABSTRACT

A method and apparatus for sequentially heat treating small parts processes the parts individually through a heat treatment process at a predetermined rate, so that each part is heat treated for a predetermined time and all parts are heat treated equally. A plurality of parts on pallets are arranged in a vertical stack in a heat treatment furnace, and parts are sequentially removed and inserted at the ends of the stack at predetermined intervals so that each part progresses from one end of the stack to the other. A vertical guide holds a plurality of parts in a vertical stack. The parts are sequentially removed and inserted at the ends of the stack so that each part progresses from one end of the stack to the other. The stack is lifted to facilitate removing and inserting parts by a slide having movable jaws for gripping and releasing a pallet. The slide is moved between a position aligning the pallet with the stack and a position moving the pallet outside the stack, and a blocking slide is inserted to immobilize the stack when parts are removed and inserted.

11 Claims, 5 Drawing Sheets

FIG. 13
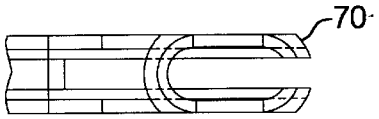
FIG. 14a
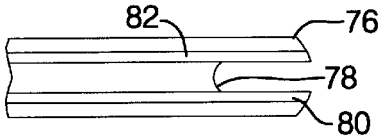
FIG. 14b
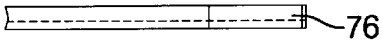
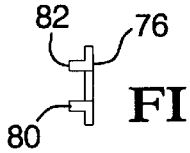
FIG. 14c
FIG. 15a
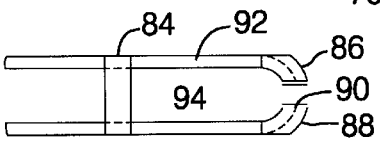
FIG. 15b
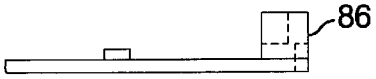
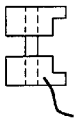
FIG. 15c
FIG. 16a
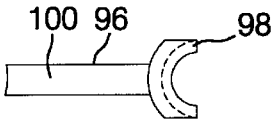
FIG. 16b
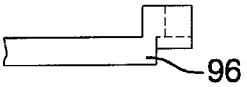
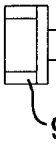
FIG. 16c
FIG. 17a
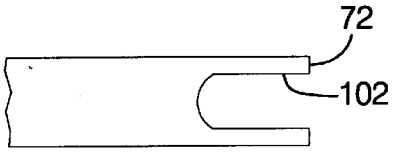
FIG. 17b
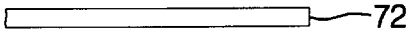
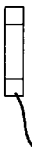
FIG. 17c
FIG. 18
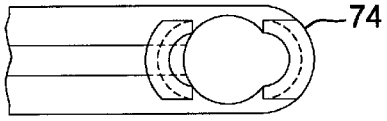
FIG. 19a
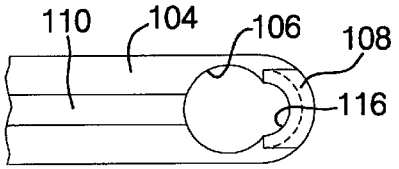
FIG. 19b
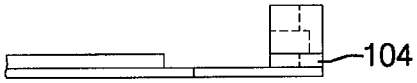
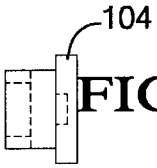
FIG. 19c
FIG. 20a
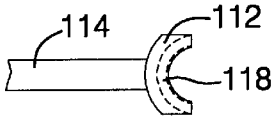
FIG. 20b
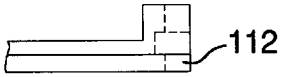
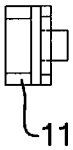
FIG. 20c

HEAT TREATMENT MATERIAL HANDLING UNIT

TECHNICAL FIELD

This invention relates to heat treatment of small parts and, more particularly, to a material handling unit for sequentially processing individual parts through a heat treatment system.

BACKGROUND OF THE INVENTION

It is customary in heat treating small parts to treat them in batches by placing a batch of such parts in a heat treatment basket and immersing in a furnace. This method of handling parts often encounters problems of consistency in the heat treatment of all parts, with some being over- or under-heat treated due to the inconsistent distribution of parts throughout the batch and resulting unequal exposure to a constant temperature and process conditions.

It would be desirable to provide a material handling unit which enables parts to be individually and consistently heat treated.

SUMMARY OF THE INVENTION

It is an object of this invention to provide a material handling unit which enables parts to be individually and consistently heat treated.

In one aspect, this invention features a method for sequentially processing a plurality of parts individually through a heat treatment process at a predetermined rate, whereby each part is heat treated for a predetermined time so that all parts are heat treated equally, comprising the steps of arranging a plurality of parts in a vertical stack in a heat treatment furnace, and sequentially removing and inserting parts at the ends of the stack at predetermined intervals so that each part progresses from one end of the stack to the other.

Preferably, the method includes the steps of lifting the stack to facilitate removing and inserting parts, removing a part from one of the top or bottom end of the stack, and inserting a part into the other of the top or bottom of the stack.

In another aspect, this invention features a material handling unit for sequentially processing a plurality of parts individually through a heat treatment process at a predetermined rate, whereby each part is heat treated for a predetermined time so that all parts are heat treated equally. A vertical guide holds a plurality of parts in a vertical stack. Slides with movable jaws are provided at the top and bottom of the stack for sequentially removing and inserting parts at the ends of the stack so that each part progresses from one end of the stack to the other, and a blocking bar is inserted to immobilize the stack during removal and insertion of parts. A rod lifts the stack to facilitate removing and inserting parts.

Preferably, the material handling unit includes a pallet supporting each part. The slides move between a position aligning the pallet with the stack and a position moving the pallet outside the stack. The vertical guide maintains alignment of the stack of parts and can be a vertical tube or three or more spaced vertical rods.

BRIEF DESCRIPTION OF THE DRAWINGS

FIG. 13 is a detail plan view of the lower slide assembly used in the material handling unit of this invention;

FIGS. 14*a*, 14*b* and 14*c* are plan, side and end views of the bottom slide member of the upper slide assembly of FIG. 13;

FIGS. 15*a*, 15*b* and 15*c* are plan, side and end views of the outer clamping member of the upper slide assembly of FIG. 13;

FIGS. 16*a*, 16*b* and 16*c* are plan, side and end views of the inner clamping member of the upper slide assembly of FIG. 1;

FIGS. 17*a*, 17*b* and 17*c* are plan, side and end views of the blocking bar used in the material handling unit of this invention;

FIG. 18 is detail plan view of the upper slide assembly used in the material handling unit of this invention;

FIGS. 19*a*, 19*b* and 19*c* are plan, side and end views of the outer clamping member of the upper slide assembly of FIG. 18;

FIGS. 20*a*, 20*b* and 20*c* are plan, side and end views of the inner clamping member of the upper slide assembly of FIG. 18;

DESCRIPTION OF THE PREFERRED EMBODIMENT

Figure 1:
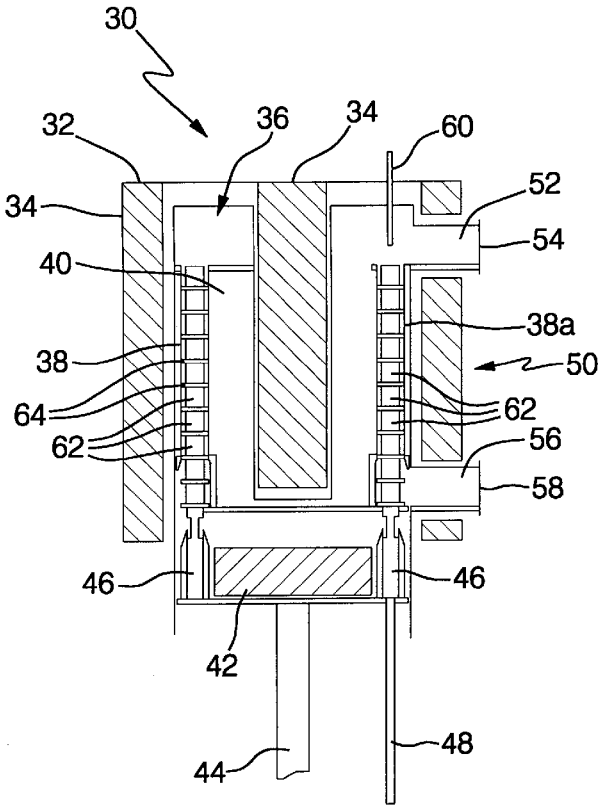
FIG. 1 is a vertical sectional view of a portion of a heat treating furnace schematically illustrating the structure of a heat treatment material handling unit for heat treating small parts according to this invention.
Figure 2:
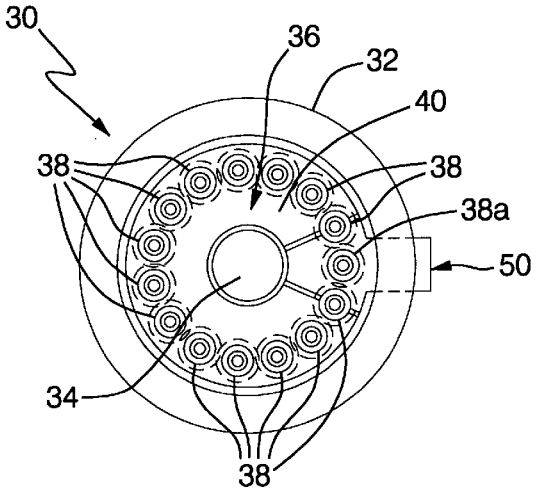
FIG. 2 is a horizontal sectional view of the material handling unit of FIG. 1.

FIGS. 1 and 2 show a portion of a heat treating system that includes a heat treatment material handling unit 30, which is utilized to process a plurality of small parts, as will be described in detail later. Unit 30 comprises a cylindrical housing 32 made of an insulating material, and a heating element 34, forming a toroidal heat treating chamber 36. A plurality of cylindrical heat treating vertical guides in the form of tubes 38 are annularly spaced within chamber 36 and are mounted on a rotatable cartridge 40, having a base 42 and a drive spindle 44 that is driven by an electric motor (not shown). A computerized controller (not shown) controls movement of the elements of the heat treatment material handling unit 30 via conventional hydraulic or pneumatic operators.

Base 42 mounts a plurality of vertically-slidable lift rods 46, one for each tube 38. An actuator rod 48 is located beneath a transfer station 50, located at one side of furnace 30, that includes an entry chamber 52, having a door 54, and an exit chamber 56, having a door 58. Actuator rod 48 reciprocates to engage and lift the lift rod 46 of whichever tube 38 is located at the transfer station 50. A sensing rod 60 is located at the top of transfer station 50 in alignment with tube 38.

The heat treating material handling units of this invention are designed to handle many small parts, such as two-inch steel transmission gears, individually. As illustrated, unit 30 comprises 15 of the tubes 38, each of which is shown containing a stack of 10 parts 62, each carried by a pallet 64. Details of the parts and pallets will be later described in reference to FIGS. 21–25. Each part is handled separately and is heat treated for the same predetermined time. For example, if heat treating time is 750 seconds, parts must be inserted into and removed from unit 30 every five seconds. Although unit 30 is illustrated as containing 150 parts, more or fewer can be processed simultaneously by varying the number or diameters of tubes 38, or by varying the height of the stack of parts.

The removal and insertion of parts, detailed in FIGS. 3–12, is provided by three slides shown in FIGS. 13–20*c*. An unloading clamping slide 70 (FIG. 13) operates in exit chamber 58, as does a blocking slide 72 (FIGS. 17*a–c*), while a loading clamping slide 74 (FIG. 18) operates in entrance chamber 54. Both slides 70 and 74 have jaws that close and open to grip and release a part 62 and its pallet 64, as described in detail later.

Figure 3:
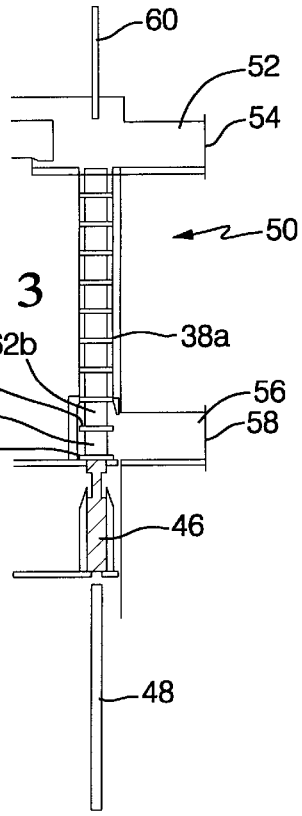
FIGS. 3 through 12 are detail views of a portion of the material handling unit of FIGS. 1 and 2, illustrating the sequencing of the parts through the unit.
Figure 4:
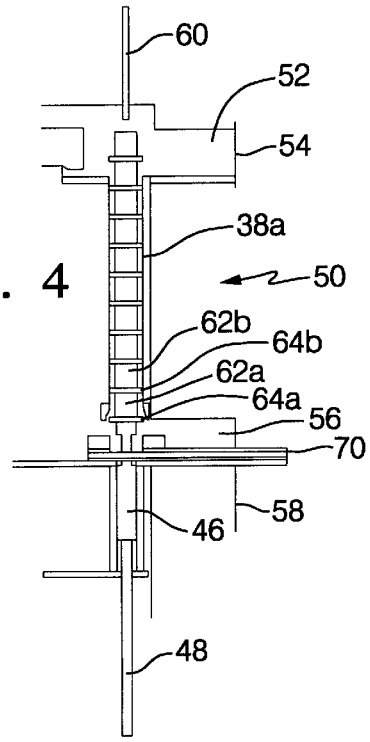

FIG. 3 illustrates tube 38*a* at transfer station 50 prior to sequential removal and insertion of parts 62. When it is time to remove a fully heat-treated part, actuator rod 48 is extended to raise lift rod 46, which engages the bottom pallet 64*a* and lifts the entire column of pallets and parts within tube 38*a*, as shown in FIG. 4. Simultaneously, door 58 opens and unloading slide 70, with open jaws, is inserted through exit chamber 56 to a position beneath the raised stack, as shown in FIG. 4.

Figure 5:
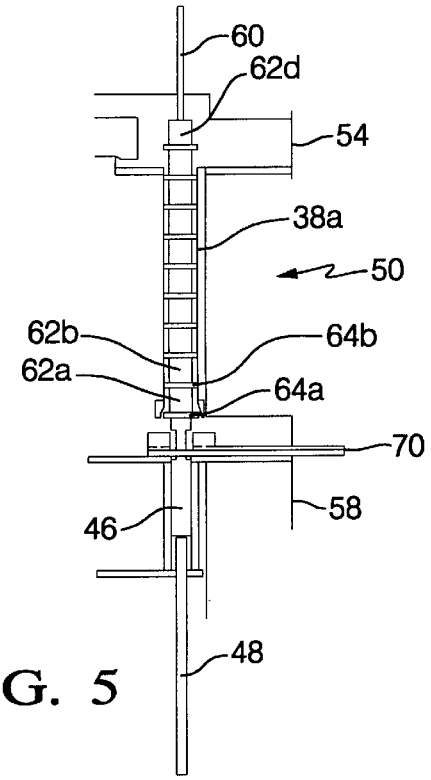
Figure 6:
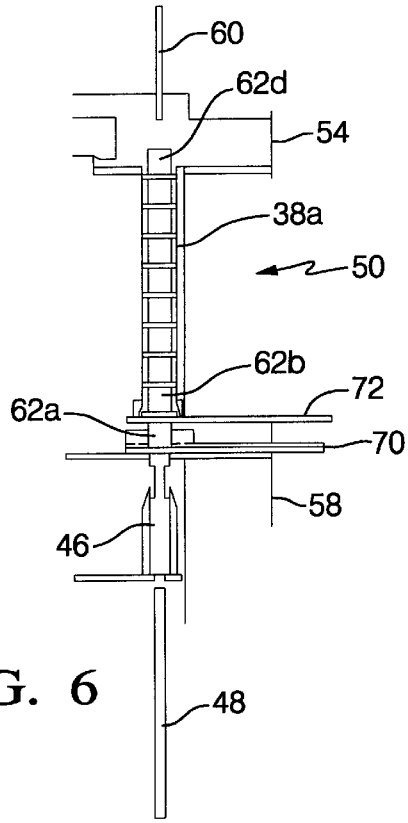
Figure 7:
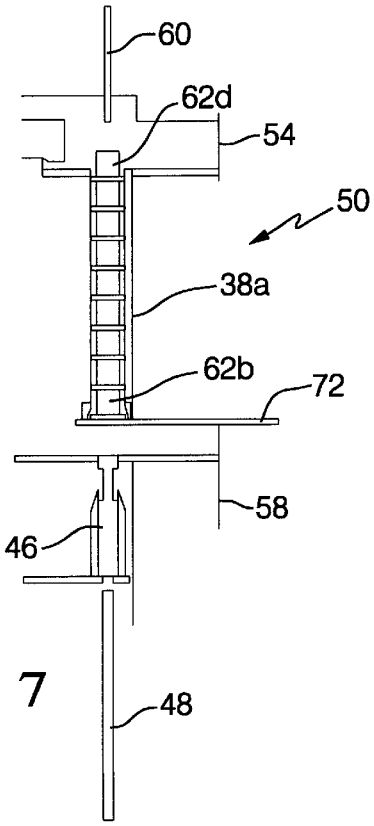

Actuator rod 48 then partially retracts to partially lower the stack, with the lowest part and pallet 62*a*, 64*a* descending from tube 38*a* to a position partially within the open jaws of unloading slide 70, as depicted in FIG. 5. Blocking slide 72 is then inserted beneath the pallet 64*b* of the next lower part 62*b*, and actuator rod 48 fully retracts to lower pallet 64*a* onto slide 70, which then closes to grip part and pallet 62*a*, 64*a*, as shown in FIG. 6. The remaining stack of nine parts and pallets is supported on blocking slide 72. Slide 70, with part 62*a* on pallet 64*a*, is removed through chamber 56, as shown in FIG. 7.

Figure 8:
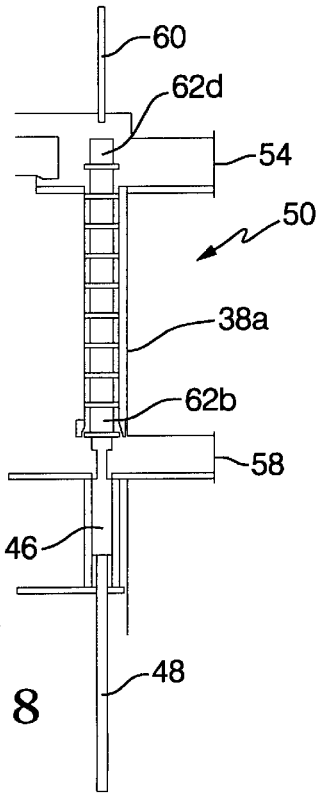
Figure 9:
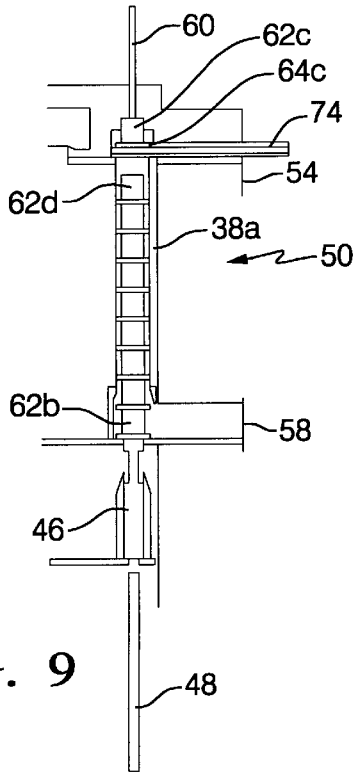
Figure 10:
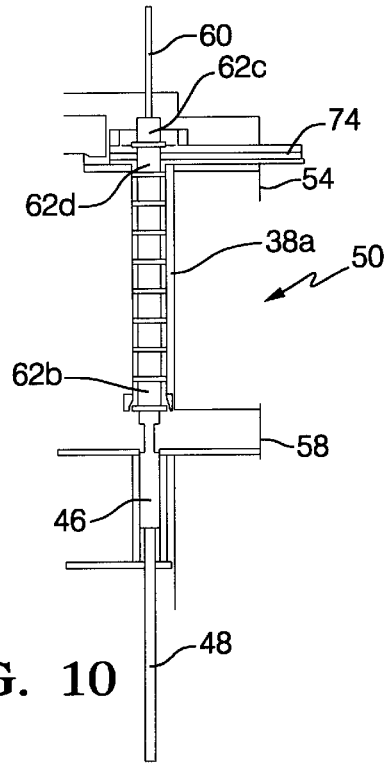

Next, in FIG. 8, actuator rod 48 extends to raise the stack of parts off blocking slide 72, which is then removed. Door 58 is closed, actuator rod 48 retracts to lower the stack of parts in tube 38*a*, and upper door 54 opens to admit loading slide 74 that carries a new part 62*c* on its pallet 64*c* and locates them above the stack, to begin heat treatment, as illustrated in FIG. 9. Sensing rod 60 is extended to detect the presence of new part 62*c*. This signals actuator rod 48 to extend to engage top part 62*d* with pallet 64*c*. When sensing rod 60 detects that part 62*c* and pallet 64*c* are lifted off loading slide 74, then actuator rod 48 stops lifting and jaws of slide 74 open to release part 62*c*, as shown in FIG. 10. Next, actuator rod 48 retracts to lower the stack of 10 parts fully, FIG. 11, and door 54 is closed after slide 74 is withdrawn from chamber 52, as in FIG. 12.

Cartridge 40 is then indexed to align another tube 38 of parts with transfer station 50. The above process is repeated endlessly to sequentially remove heat-treated parts and insert new parts at a predetermined rate, which depends on the capacity of the unit and the time of heat treatment. Parts will gradually work their way down the stacks as cartridge 40 continues to index, removing and inserting parts at a predetermined rate. In this manner, every part is handled individually and receives the identical heat treatment, unlike heat treatment in the conventional batch process.

FIG. 13 shows the assembled removal slide 70, which is in three parts, shown in FIGS. 14*a, b, c*; 15*a, b* and *c*; and 16*a, b* and *c*. A slide base 76 has a notch 78 that is wide enough to slide around lift rod 46, and a pair of guide rails 80, 82. An outer jaw 84 has a pair of grippers 86, 88 spaced by a slot 90 that are formed on the ends of rails 92, 94. Slot 90 is wide enough to allow passage around rod 46. Rails 92, 94 fit outside guide rails 80, 82 of base member 76. An inner jaw 96 comprises a gripper 98 formed on the end of a rail 100, which fits between guide rails 80, 82 of base 76. FIG. 13 illustrates the assembly of parts, with the jaws shown open as in FIG. 4. To close and clamp a part and pallet, jaws 84 and 96 are slid together on base 76, as in FIG. 6.

Blocking slide 72 (in FIG. 17) is a plate having a slot 102 that is narrower than a pallet 64, but wider than a part 62. This enables insertion around a part beneath a pallet to support the stack, as in FIG. 6.

Figure 11:
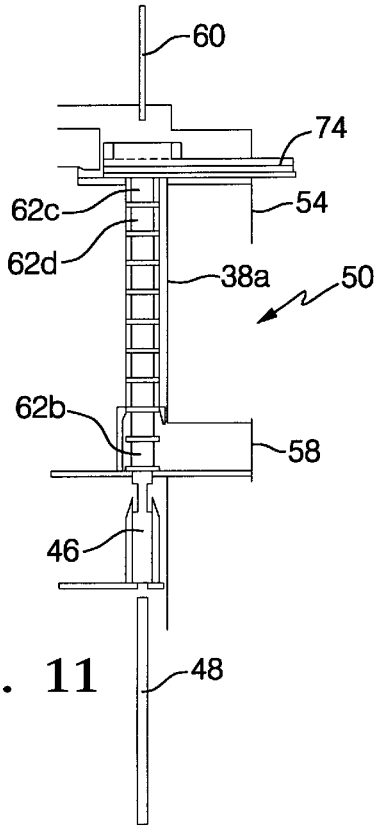
Figure 12:
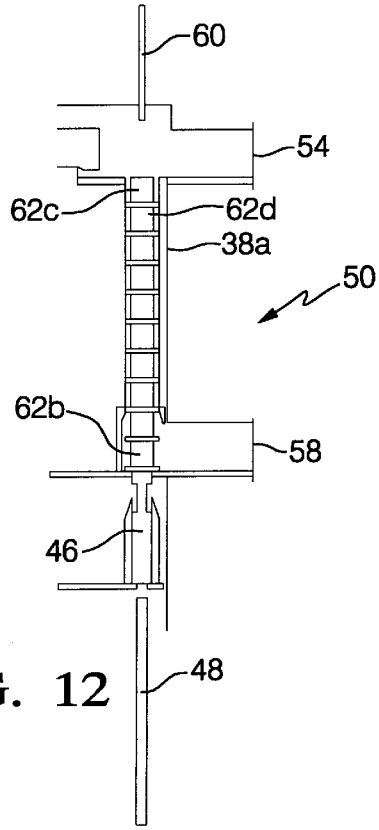

Loading slide 74 comprises a base 104 having an opening 106 bounded on one side by an outer jaw 108, and a guide slot 110. Opening 106 is larger than a pallet to enable pallet 64*c* to descend through it, as illustrated in FIGS. 10 and 11. An inner jaw 112 is mounted on the end of a rail 114. When inner jaw 112 is slid toward outer jaw 108, it forces a pallet onto the narrowed ledge 116 bordering opening 106, and the narrowed ledge 118 on jaw 112. Both ledges 116 and 118 form an opening larger than a part 62, but smaller than a pallet 64. This enables part 62*d* to engage the bottom of pallet 64*c* as in FIG. 10.

Slides 70, 72 and 74 can be operated by any conventional hydraulic or pneumatic operators, which themselves form no part of this invention. All movement is controlled by a microprocessor/controller which has been programmed in a well-known manner to operate unit 30.

Figure 21A:
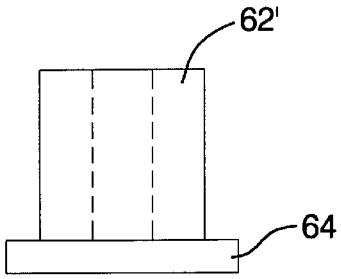
FIGS. 21*a* and 21*b* are enlarged side and top views of a relatively large part supported on a pallet for handling by the material handling unit of this invention.
Figure 22A:
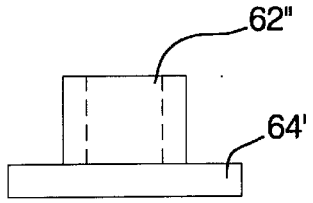
FIGS. 22*a* and 22*b* are enlarged side and top views of a relatively small part supported on a pallet for handling by the material handling unit of this invention.
Figure 21B:
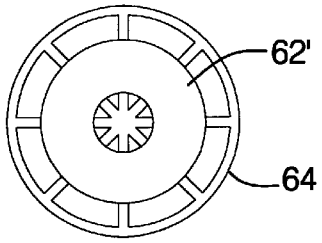
Figure 22B:
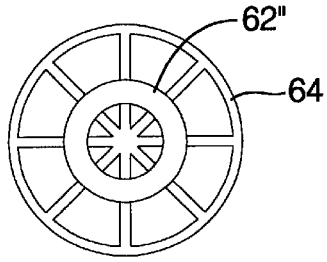
Figure 23:
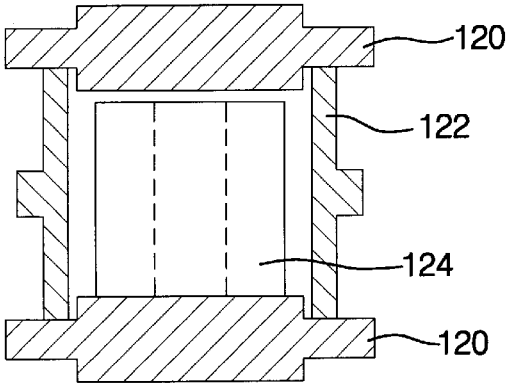
FIG. 23 is a vertical sectional view of a part contained within a cage assembly for handling by the material handling unit of this invention.
Figure 24:
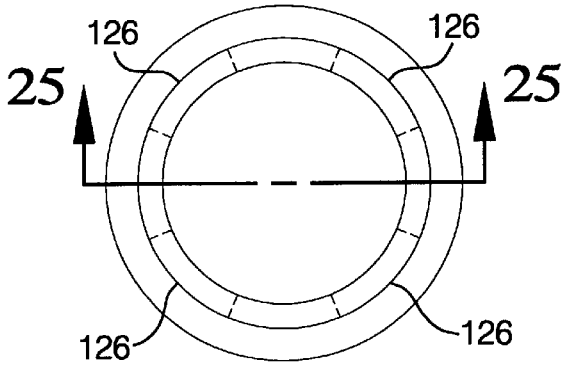
FIG. 24 is a plan view of the cage shown in FIG. 23.
Figure 25:
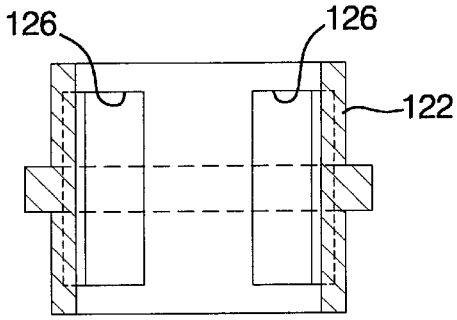
FIG. 25 is a sectional view taken along line 25—25 of FIG. 24.

FIGS. 21*a, b* and 22*a, b* illustrate in detail the range of sizes that may be heat treated with the same equipment, ranging from a small part 62" to a large part 62'—both supported on the same size pallet 64. Variations in the height the part 62 will vary the height of the stack of parts within tubes 38. Thus, in this illustrative example described above, part height is critical to operation. A change in part height may require adjustment of cycle time, stack height, and rate of part removal and insertion, which could require physical equipment modifications and operation. To enable the processing of a variety of sizes of parts with the same equipment, a modified form of pallet, shown in FIGS. 23–25, may be used.

A cage 122 within which a part 124 is confined separates a top and bottom 120. Cage 122 includes annularly spaced windows 126 to enable the free circulation of heat treating gases. Use of the cage provides a consistent height dimension for the process equipment, regardless of the size of part being heat treated. This also would eliminate the need for the sensing rod 60.

Thus, this invention enables parts to be individually and consistently heat treated in a sequential, timed manner. The apparatus and method of this invention can be utilized for any heat treatment operation, such as preheating, carburizing, equalizing, quenching, tempering and testing, While only a preferred embodiment has been shown and described, many modifications are contemplated within the scope if this invention and the appended claims. For example, the vertical guides could take a form different from tubes 38, such as three or more annularly spaced rods, which would have the identical function of maintaining the parts on pallets aligned in vertical stack as it moves up and down during part removal and insertion. Also, depending on process requirements, parts could be inserted at the top and removed at the bottom of the stack by using the same equipment.

What is claimed is:

1. A material handling unit for sequentially processing a plurality of parts individually through a heat treatment process at a predetermined rate, whereby each part is heat treated for a predetermined time so that all parts are heat treated equally, comprising a plurality of stacks mounted for movement within said chamber, a vertical guide for holding a plurality of parts in each vertical stack, a parts transfer station in said chamber for transferring parts into and out of said chamber, means for sequentially moving each stack to the transfer station, and transfer means for sequentially removing and inserting parts at both ends of stack, when the stack is at the transfer station, so that each part progresses from one end of the stack to the other as the stacks move sequentially through the chamber, said transfer means including means for lifting the stack to facilitate removing and inserting parts, means for removing a part from one of the top or bottom end of the stack, and means for inserting a part into the other of the top or bottom of the stack.

2. The material handling unit of claim 1, including a pallet supporting each part, wherein the means for removing the parts and the means for inserting the parts each comprise a slide having movable jaws for gripping and releasing a pallet, means for moving the slide between a position aligning the pallet with the stack and a position moving the pallet outside the stack, and means for moving the jaws.

3. The material handling unit of claim 2, including means to engage the next-to-bottom pallet when lifted by the lifting means to support the stack to facilitate movement of parts at both ends of the stack.

4. The material handling unit of claim 3, wherein the vertical guide is a cylindrical tube.

5. The material handling unit of claim 3, wherein the vertical guide comprises at least three spaced vertical rods.

6. The material handling unit of claim 2, including a heat treatment cell having a plurality of vertical guides and stacks of parts, a top door in the cell controlling access to the top of a stack, a bottom door in the cell controlling access to the bottom of the same stack, and means for indexing each stack to a loading/unloading station aligned with said doors such that the slides are slidable through the doors to access the both ends of the stack to withdraw and insert parts.

7. The material handling unit of claim 6, including control means for controlling the rate at which parts are withdrawn from and inserted into the cell, whereby the number of parts in the cell equals the predetermined time multiplied by the predetermined rate.

8. The material handling unit of claim 6, wherein the vertical guides and stacks are arranged in a circle, and the cell includes a central heat source, a rotatable base and means for rotating the base to move each stack successively to said loading/unloading station.

9. A material handling unit for sequentially processing each of a plurality of parts through a heat treatment cell for a predetermined period of time, comprising a vertical guide for holding a plurality of parts in a vertical stack, means for sequentially interchanging parts at the top and bottom of the stack at a predetermined rate, including means for lifting the stack to a raised position and lowering the stack to a lowered position, means for selectively maintaining the stack in raised position, means for withdrawing a part from the bottom of the stack when the stack is in raised position, and means for inserting a part into the top of the stack, and control means for selectively varying said predetermined period of time and said predetermined rate, whereby the number of parts in the stack equals the predetermined time period multiplied by the predetermined rate.

10. A method for sequentially processing a plurality of parts individually through a heat treatment process at a predetermined rate, whereby each part is heat treated for a predetermined time so that all parts are heat treated equally, comprising the steps of arranging a plurality of parts in a vertical stack in a heat treatment furnace, arranging a plurality of stacks of parts in said furnace, providing a parts transfer station in said furnace for moving parts into and out of said furnace, moving said stacks of parts sequentially to said transfer station, and sequentially removing and inserting parts at both ends of a stack at predetermined intervals when the stack is at the transfer station so that each part progresses from one end of the stack to the other and is heat treated equally.

11. The method of claim 10, wherein the step of sequentially removing and inserting parts at the ends of the stack comprises the steps of lifting the stack to facilitate removing and inserting parts, removing a part from one of the top or bottom end of the stack, and inserting a part into the other of the top or bottom of the stack.

* * * * *